US005482196A

United States Patent [19]

Doyel

[11] Patent Number: 5,482,196

[45] Date of Patent: Jan. 9, 1996

[54] ATTACHING ARTICLES TO SHEET MATERIAL WITH FLEXIBLE TIES

[76] Inventor: John S. Doyel, 404 W. 20th St., New York, N.Y. 10011

[21] Appl. No.: 34,098

[22] Filed: Mar. 22, 1993

[51] Int. Cl.[6] ..... B65C 7/00

[52] U.S. Cl. ..... 227/67; 227/8; 227/156

[58] Field of Search ..... 227/67, 69, 70, 227/71, 72, 8, 68, 73, 74, 75, 156; D8/51

[56] References Cited

U.S. PATENT DOCUMENTS

| | | | |
|---|---|---|---|
| D. 271,178 | 11/1983 | Suzuki | 227/67 |
| D. 327,398 | 6/1992 | Meyers | D8/51 |
| 4,664,306 | 5/1987 | Levy | 227/67 |
| 4,681,248 | 7/1987 | Duchin | 227/67 |

*Primary Examiner*—Richard K. Seidel
*Assistant Examiner*—Allan M. Schrock
*Attorney, Agent, or Firm*—Cooper & Dunham

[57] ABSTRACT

A hand operated implement for attaching articles such as buttons or tags to sheet material such as fabric with flexible ties by loading a grooved needle with the bar of a tie having a stem to which the article is attached, pushing the needle through the material and pushing the bar out of the needle such that the bar is at one side of the material while the article and at least some of the stem are at the other side. A needle cover attached to the implement pivots between a storage position in which it covers the sharp end of the needle and an operative position in which it serves as a thumb rest for operating the mechanism pushing the flexible tie's bar out of the needle. A storage compartment is provided within the implement.

9 Claims, 7 Drawing Sheets

ATTACHING ARTICLES TO SHEET MATERIAL WITH FLEXIBLE TIES

BACKGROUND OF THE INVENTION

The invention is in the field of hand operated implements used to attach articles such as buttons and tags to sheet material such as fabric with flexible ties that are pushed through the article and the material. Such implements have been known for some time, and some have been commercially available. Examples are discussed in at least some of U.S. Pat. Nos. 1,364,936; 1,854,647; Re. 19,541; 2,069,878; 2,140,795; 2,462,717; 2,729,177; 2,952,851; 3,349,447; 3,470,834; 3,494,004; 3,158,729; 3,566,452; 3,650,451; 3,650,452; 3,652,004; 3,659,769; Re. 27,357; 3,734,375; 3,735,908; 3,754,304; 3,759,435; 3,797,722; 3,815,798; 3,872,806; 3,875,648; 3,880,339; 3,893,612; 3,894,317; 3,895,753; 3,900,925; 4,063,312; Des. 213,418; Des. 14,122; Des. 214,123; Des. 214,151; Des. 214,152; Des. 214,153; Des. 14,235; Des. 230,419; Des. 230,666. An example which is believed to have been on sale in this country in the 1970's is illustrated in a 2-page brochure or flier entitled "Button Fastener," copyright 1972, Products International Co., Canoga Park, Calif. 91304.

SUMMARY OF THE INVENTION

In a particular and non-limiting example, the invention is embodied in an implement and a method for attaching articles such as buttons or tags to sheet material such as fabric with flexible ties. The implement is generally pistol-shaped and comprises a housing having a handle shaped and dimensioned to be grasped by the hand of a user and a barrel extending forwardly from the handle and having a channel formed therein. A needle extends forwardly from the barrel and has a sharp free end for penetrating material and a groove extending rearwardly from the sharp end. The groove is shaped to accommodate the bar of a flexible tie that also has a stem. The tie's bar slides along the groove and exits the sharp end thereof when pushed with a pusher which also slides in the same groove, behind the tie's bar. The pusher extends forwardly from a slide that is secured in the barrel channel to slide therealong. The slide and pusher are biased rearwardly, e.g., by a compression spring surrounding the pusher. In order both to protect the needle and the user when the fastening device is not being used and to provide a convenient thumb rest for pushing the slide forwardly when the implement is being used, a needle cover is pivotally secured to the slide to pivot between a storage position in which it envelops the sharp end of the needle and an operative position in which it exposes the sharp end. When in its operative position, the needle cover slides along the housing rearwardly to allow a flexible tie to be loaded into the needle and forwardly to push the slide forwardly and thereby to push the pusher forwardly to drive the tie loaded in the needle forwardly and out of the needle. To keep the needle out of contact with the cover when the cover is in its storage position, a stop is provided as a part of the barrel to allow the cover to be lowered over the needle only when the cover would clear the needle and to keep the needle spaced from the cover when the cover is pulled back to its storage position by the action of the spring on the slide. In the storage position, a box-like enclosure at the front end of the cover envelops the needle. In the operative position, an interlocking mechanism engages the needle cover with the housing to restrict the needle cover to a sliding path which is substantially parallel to the needle. The interlocking mechanism is manually engageable and releasable to permit movement of the needle cover to and from its storage and operative positions. The handle encloses a storage compartment that can be closed with an access door in the form of a plate sliding along grooves in the handle forwardly to close the storage compartment and rearwardly to open the compartment.

The housing can be assembled from two half-shells which are substantially mirror images of each other relative to a plane which intersects centrally both the handle and the barrel. Each of these halves can be molded as an integral piece from a plastic material. Both halves, as well as all other parts of the device except possibly for the needle, the pusher and the biasing spring, can be molded in a single mold from the same plastic material. The shapes and dimensions of the parts are carefully selected to make assembly particularly convenient by having the parts interfit and engage without the need for tools. Assembly of the implement can be completed with adhesives or sonic weld sealing of the two half-shells to each other.

In operation, the implement is stored with the needle cover in its storage position, enclosing the sharp end of the needle from five out of six sides with its box-like front end. To move the cover to its operative position, the user pulls the cover a short distance forward, so that the protective box at the forward end of the needle clears the sharp tip of the needle, and pivots the cover about the slide upwardly and then rearwardly so the cover extends back from the slide and is close to the top of the handle. The user then pushes the cover forwardly against the bias of the spring, while keeping it close to the top of the handle, until a hole in the needle cover aligns with a T-shaped projection rising from the top of the handle and the user can push the cover down so that the projection enters that hole. The bias spring then drives the cover forward while the vertical part of the T-shaped projection stays within a slot in the cover but the bar of the T is above the slot and keeps the cover close to the handle, sliding along a path parallel to the needle.

DETAILED DESCRIPTION

Figure 1:
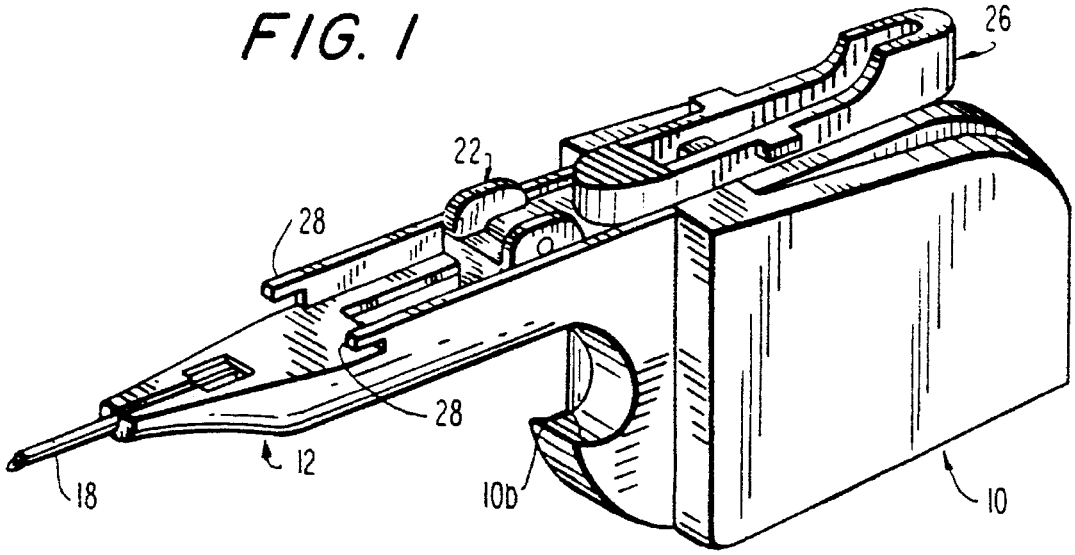
FIG. 1 is a perspective view of a hand-operated implement device embodying an example of the invention, with a needle cover in its operative position.
Figure 3:
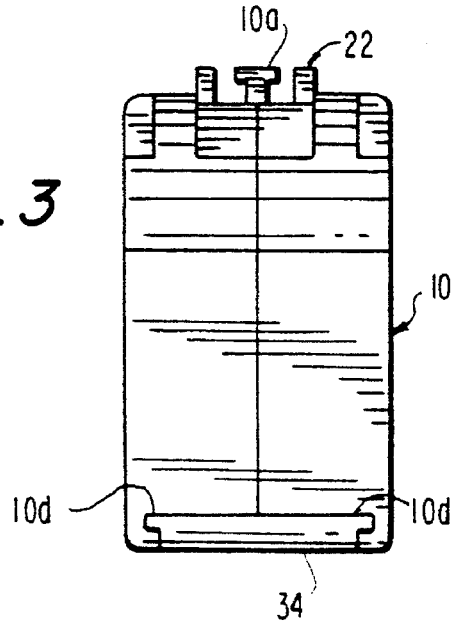
FIG. 3 is a back elevation of the implement.
Figure 6:
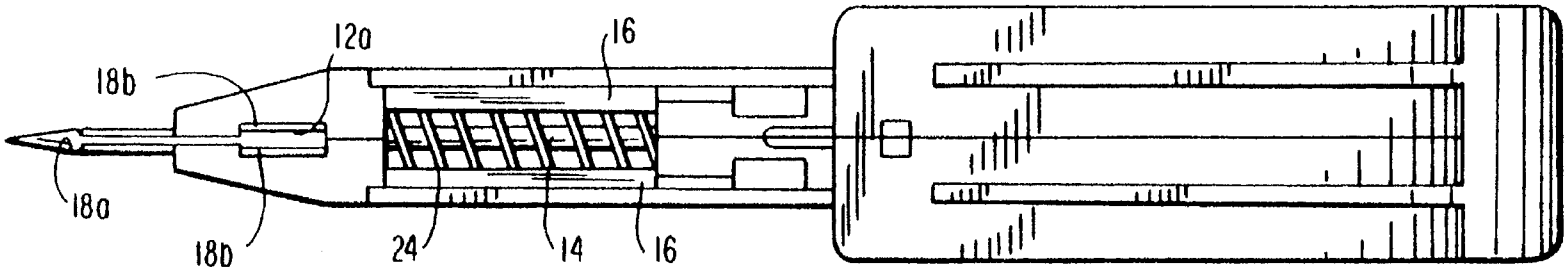
FIG. 6 is a top view of the implement without the needle cover, an shows in outline the normally concealed mounting tabs of the needle.
Figure 6B:
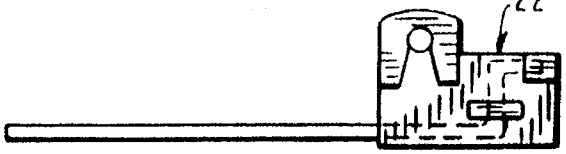
FIG. 6*a* is an elevation of the pusher and FIG. 6*b* is an elevation of the pusher secured in the slide.
Figure 6A:
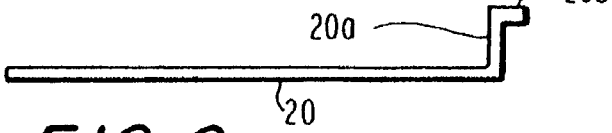

Referring to the drawings, an exemplary hand-operated implement embodying the invention comprises a generally pistol-shaped housing having a handle 10 shaped and dimensioned to be grasped by the hand of a user and a barrel 12 extending forwardly (to the left in FIG. 1) from handle 10 and having a channel 14 with a slide track 16 formed therein. Slide track 16 is made up of a horizontal (in FIG. 6) ledge 16*a* extending from each half of barrel 14 toward ledge 16*a* of the other half, with some space being left between the two ledges 16*a* when the housing is assembled. A grooved needle 18 extends forwardly (to the left in FIG. 5) from barrel 12 and has a sharp free end for penetrating material such as fabric and a groove 18*a* (see FIG. 6) which extends rearwardly (to the right in FIG. 5) and is shaped to accommodate a bar 19*a* of a flexible tie which also has a stem 19*b* and a ball 19*c*. Groove 18*a* is shaped to allow bar 19*a* to slide therealong and to exit the sharp end of needle 18 when pushed by a pusher 20 which is the form a rod fitting relatively loosely in groove 18*a*.

Figure 2:
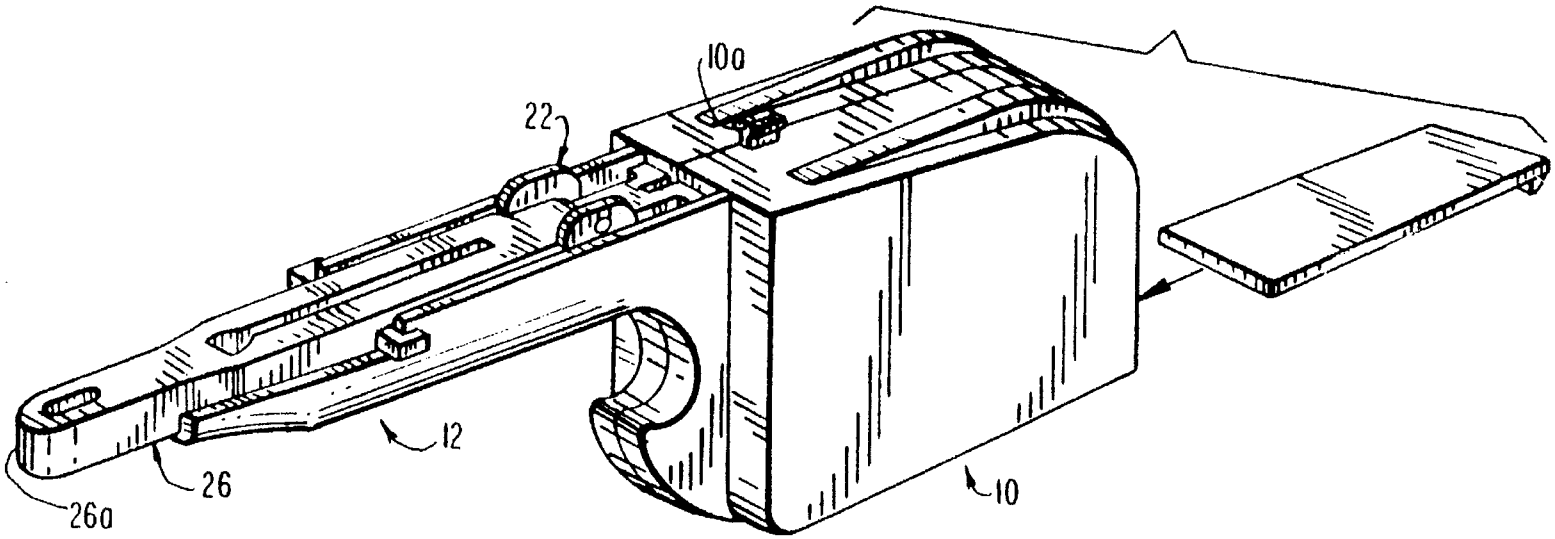
FIG. 2 is a similar perspective view but with the needle cover in its storage position and with a removed access door to a storage compartment.
Figure 4:
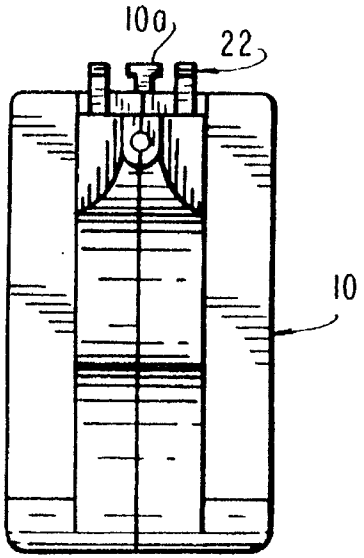
FIG. 4 is a front view.

Pusher 20 extends forwardly from a slide 22 which slides along track 16 of channel 14 in barrel 12. Slide 22 and pusher 20 are biased rearwardly (to the right in FIG. 5), e.g., by a compression spring 24 surrounding pusher 20. In order both to protect needle 18 and the user when the implement is not being used as well as to provide a convenient thumb rest for pushing slide 22 forwardly when the implement is being used, a needle cover 26 is pivotally secured to slide 22 to pivot between a storage position seen in FIG. 2 in which it envelops the sharp end of needle 18 and an operative position seen in FIG. 1 in which it exposes needle 18. While in its operative position, needle cover 26 can slide along the housing rearwardly to allow a flexible tie such as 19 to be loaded into groove 18*a* in needle 18, and forwardly to push slide 22 forwardly and thereby to drive pusher 20 forwardly and thereby drive a tie such as 19 loaded in needle groove 18*a* forwardly and out of needle 18. To keep needle 18 out of contact with needle cover 26 when cover 26 is in its storage position, a stop 28 is provided as a part of barrel 12 which interacts with tabs 30 (see FIG. 5*c*) in needle cover 26 to allow cover 26 to be lowered over needle 18 only when a box-like enclosure 26*a* at the front end of cover 26 would clear needle 18 and to keep needle 18 spaced from needle cover 26 when the cover is pulled back and locked into stop 28 by the action of spring 24 on slide 22. In the storage position, tabs 30 lock into stop 28 so that a deliberate pull of needle cover 26 forward, against the bias of spring 24, is required to release needle cover 26 from stop 28 and allow cover 26 to be pivoted counterclockwise (in the view of FIG. 5). Box-like enclosure 26*a* at the front end of needle cover 26 envelops needle 18 and surrounds the sharp end of needle 18 on 5 out of 6 sides (on all sides except that facing handle 10). In the operative position of needle cover 26, an interlocking mechanism comprising a T-shaped projection 10*a* rising from handle 10 and a keyed slit 26*b* (see FIG. 5*c*) form an interlocking mechanism that provides engagement between cover 26 and housing handle 10 to restrict cover 26 to sliding along a path close to handle 10 and substantially parallel to needle 18. Slit 26*b* is keyed by having a larger opening 26*b*' to admit therein the bar of T-shaped projection 10*a*, but the rest of slit 26*b* cannot clear this bar and therefore the needle cover stays close to handle 10 in the remainder of its forward sliding motion. This interlocking mechanism is manually engageable and releasable to permit movement of the needle cover between its storage and operative positions.

Handle 10 is hollow and encloses a storage compartment 32 (see FIG. 5) that can be closed with an access door 34 in the form of a plate sliding along tracks 34 in handle 10 forwardly to close storage compartment 32 and rearwardly to open storage compartment 32. Items such as buttons and flexible ties can be stored in storage compartment 32.

Figure 5A:
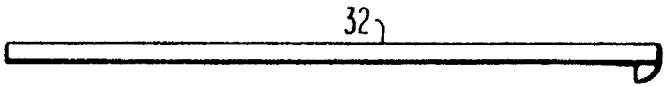
FIG. 5*a* is an elevation of the access door and FIG. 5*b* is a bottom view of the access door.
Figure 5B:
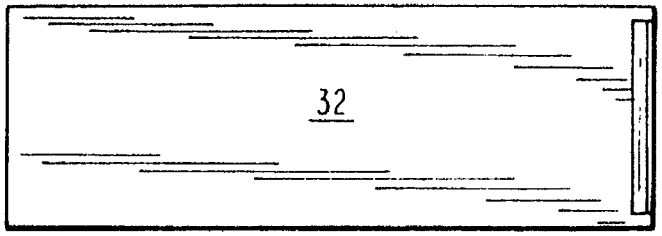
Figures 5, 5C, 5D, 5E, 5F, 5G, 5H, 5I, 7:
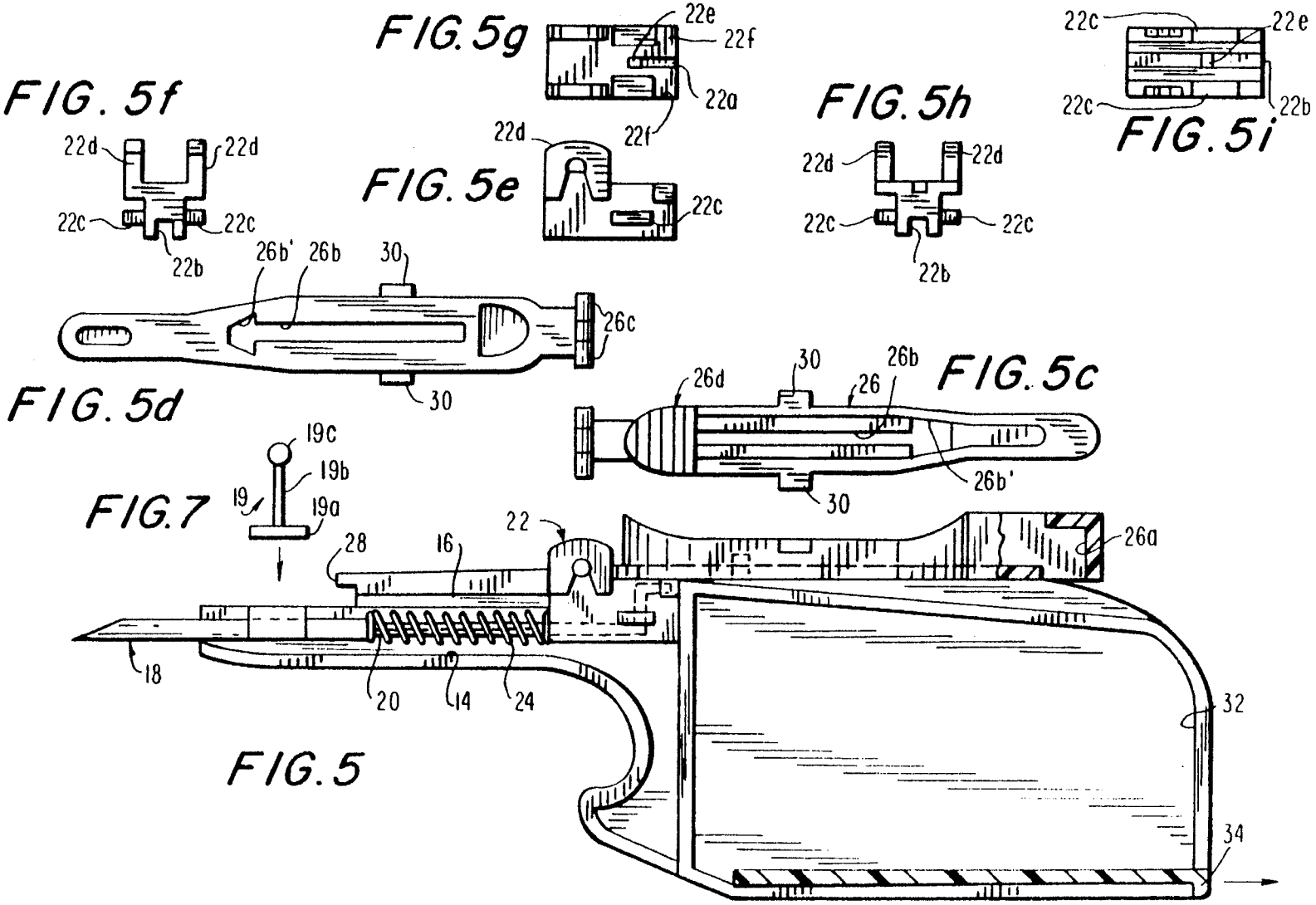
FIG. 5 is an elevation of a half-shell forming the implement together with the needle cover shown in its operative position and in section, and together with a slide, a pusher and a spring shown in place.
FIG. 5*c* is a top view and FIG. 5*d* is a bottom view of the needle cover.
FIG. 5*e* is a side view of the slide and FIGS. 5*f* through 5*i* are, respectively, front elevation, top view, back elevation and a bottom view of the slide.
FIGS. 7–13 illustrate examples of flexible ties for use with the implement.

The housing can be assembled from two half-shells which are mirror images of each other relative to a plane which intersects centrally both handle 10 and barrel 12 (i.e., a plane parallel to the paper in FIG. 5). Each of these half-shells can be molded as an integral piece from a plastic material. Both half-shells, as well as other parts of the implement can be molded in a single mold from the same plastic material; however, slide 22 preferably is made from a different material that would not weld to the half-shell, when they are sonically welded or glued, and needle 18, pusher 20 and spring 24 can be made of metal. The shapes and dimensions of the parts are carefully selected to make assembly particularly convenient, with the parts interfitting and engaging without the need for tools. The two half-shells can be affixed to each other by means such as an adhesive or with sonic welding to finalize assembly. Thus, slide 22 can be molded as an integral piece of plastic material with a slit 22*a* above and a slit 22*b* below, each parallel to needle 18, and with a tab 22*c* projecting from each side. An integral aperture in tab 22*d* extends upwardly from each side at the forward end of slide 22. Needle cover 26 and slide 22 snap-lock to each other in a pivotal connection by inserting each of tabs 26*c* of cover 26 into a respective loop 22*d* in slide 22. The material of slide 22 is sufficiently flexible to permit one or both of tabs 22*d* to bend outwardly to permit such assembly with needle cover 26. Pusher 20 is assembled with slide 22 as seen in FIG. 5*b*, by inserting the back end of pusher 20 upwardly into slit 22*b* such that an upwardly extending part 20*a* of pusher 20 enters an opening 22*e* where slit 22*a* and slit 22*b* overlap, and pushing the back end 20*b* into slit 22*a*. Spring 24 is then placed over pusher 20, as seen in FIG. 5, and needle 18 is placed over the forward end of pusher 20. This subassembly of needle 18, pusher 20, slide 22 and needle cover 26 is placed over the open half of the housing as seen in FIG. 5, with tabs 18*b* of needle 18 fitting into mating openings (not shown) in barrel 12 (see FIG. 6), and with the ledges forming slide track 16 interlocking with slide 22 by fitting in the slots formed between tabs 22*c* on the one hand and, on the other hand, the bottom ends of tabs 22*d* and tabs 22*f*. The other half of the housing is then placed to fit in a mirror image fashion over the subassembly and the two halves are fastened to each other, e.g., with an adhesive or by sonic welding. Needle cover 26 is pivoted to its storage position, access door 34 is slid into mating tracks 10*d* in handle 10 (perhaps after placing suitable contents in storage compartment 32). The implement then is ready for packaging and shipping.

To use the implement, the user pushes needle cover 26 forward against the bias of spring 24 until box-like enclosure 26*a* clears needle 18. The user then pivots needle cover 26 counterclockwise (in the view of FIG. 5) until needle cover 26 is against handle 10, and pushes needle cover 26 forward until the bar of T-shaped upward projection 10*a* goes into slit in 26*b* to form an interlocking mechanism, and releases needle cover 26 so that the force of spring 24 can move it back to the position seen in FIG. 1.

To fasten an article to sheet material, the user inserts the bar 19*a* of a flexible tie such as 19 into an opening 12*a* of barrel 12 from above. This opening 12*a* is lined up with groove 18*a* in needle 18, so that the tie's bar 19*a* can go into groove 18*a* while stem 19*b* protrudes up through opening 12*a*. This opening 12 extends all the way through the forward end of barrel 12 and, although it may narrow, is sized to allow a stem such as 19*b* to pass therethrough. The user then pushes needle 18 into sheet material and pushes needle cover 26 forward to move bar 19*a* of flexible tie 19 forwardly through and out of groove 18*a*. Meanwhile, stem 19*b* rides through opening 12*a*, and stays with bar 19*a* but only a part of it is pushed into the sheet material. The user then withdraws needle 18 from the sheet material, but bar 19*a* remains on the other side of the material while stem 40*b* passes through the material but button 19*c* remains on this side of the material.

In some cases it may be desirable, or necessary, to lead the bar of the flexible tie, such as bar 19*a* , directly into groove 18*a*, near the sharp end of needle 18, while holding slide 22 pushed forward against the bias of spring 24, to keep the bar from sliding backward along track 18*a*.

Figure 10:
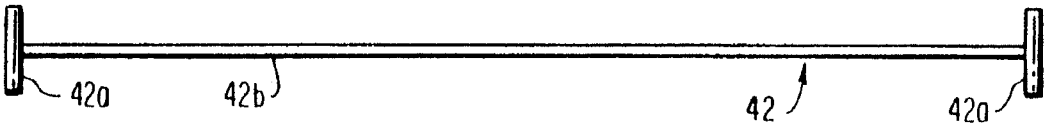
Figure 12:
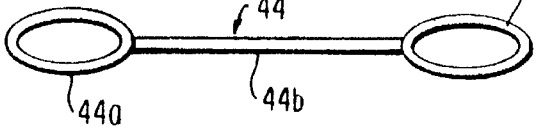
Figure 13:
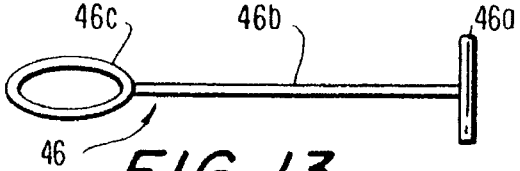
Figure 11:
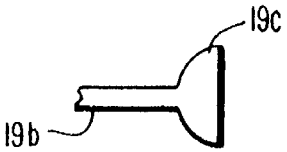
Figure 8:
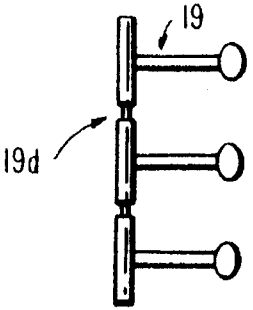
Figure 9:
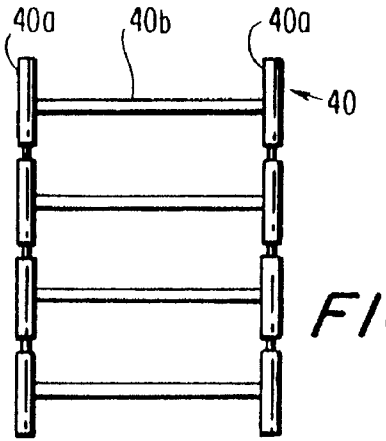

Flexible tie 19 is but one example of ties suitable for use with the implement discussed above. Such flexible ties can be molded of a material such as nylon in strips such as shown in FIG. 8, with weakened lines 19*d* between adjacent ties 19 so that an individual tie can be separated by hand. Another example of such ties is shown in FIG. 9, in which each tie 40 has a bar 40*a* at each end of a stem 40*b* . An example of a tie 42 with a longer stem 42*b* and similar bars 42*a* is shown in FIG. 10. FIG. 11 shows a button 19*c*' which can be used in place of button 19*c* of tie 19 shown in FIG. 7. FIG. 12 shows another flexible tie, this time in the form of an extension tie 44 which has loops 44*a* at each end of a stem 44*b*. FIG. 13 shows a flexible tie 46 which has a bar 46*a* and a loop 46*c* at the ends of a stem 46*b*.

Figure 14A:
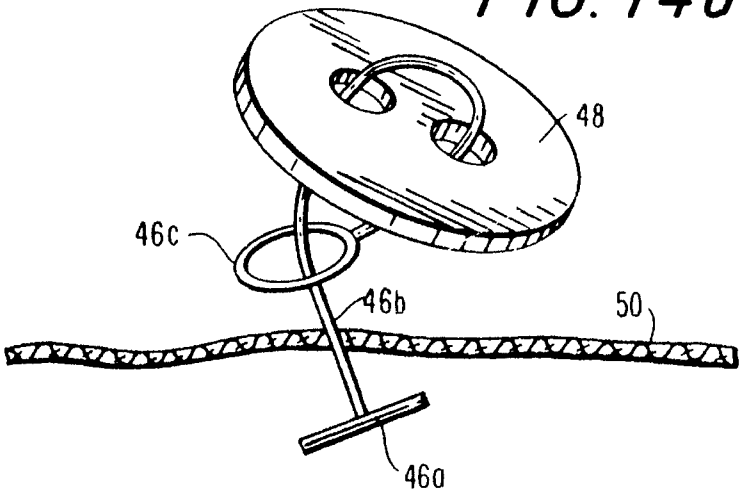
FIGS. 14–19 illustrate use of flexible ties.
Figure 16:
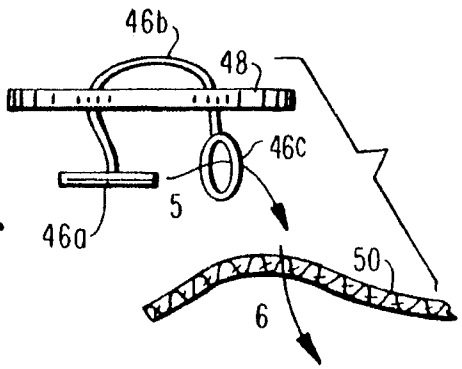
Figure 14:
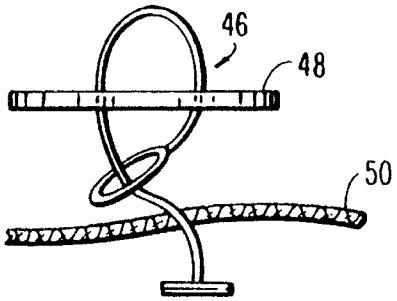
Figure 15:
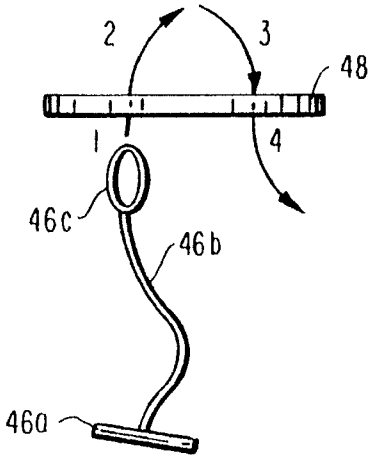

FIGS. 14 and 14*a* shows an a button affixed to fabric 50 with a flexible tie 46, and FIGS. 15 and 16 illustrate the sequence of steps used to attach a button in this manner using the implement described above. First, the user pushes by hand loop 46*c* up one hole and down another of button 48, as seen in steps 1–4 of FIG. 15. Then the user loads flexible bar 46*a* in groove 18*a* of needle 18 of the implement discussed above, pushes needle 18 through loop 46*c* as illustrated at step 5 in FIG. 16, and then through sheet material 50 as illustrated at step 6, and then pushes needle cover 26 forward to drive bar 46*a* of flexible tie 46 out of needle 18, and withdraws needle 18 to leave button 48 fastened to sheet material 50 as illustrated in FIGS. 14 and 14*a*.

Figure 17A:
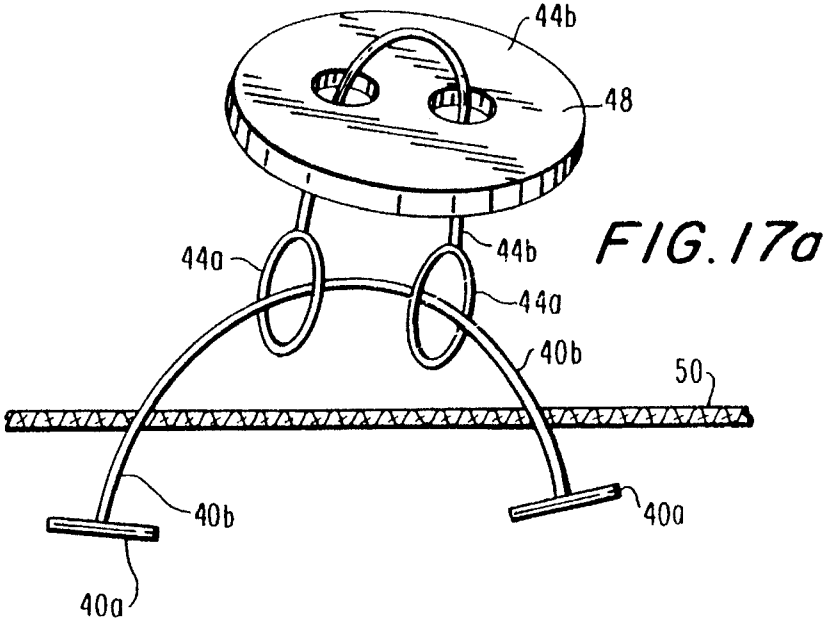
Figure 17:
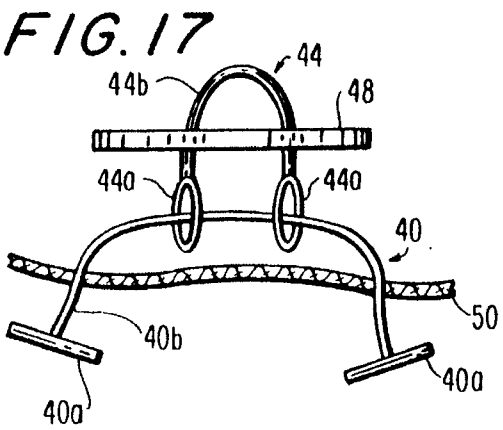

Extension 44 can be used as illustrated in FIGS. 17 and 17*a*, together with tie 40, by first attaching extension 44 to button 44 by hand-threading loops 44*a* down through respective holes in the button, then threading a bar 40*a* of tie 40 by hand through each loop 44*a*, and then loading one bar 40*a* into the implement as described above and using the implement to push the bar through material 50 as earlier described and then doing the same with the other bar 40*a*.

Figure 18:
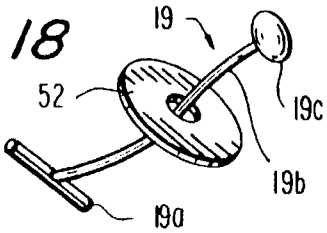
Figure 19:
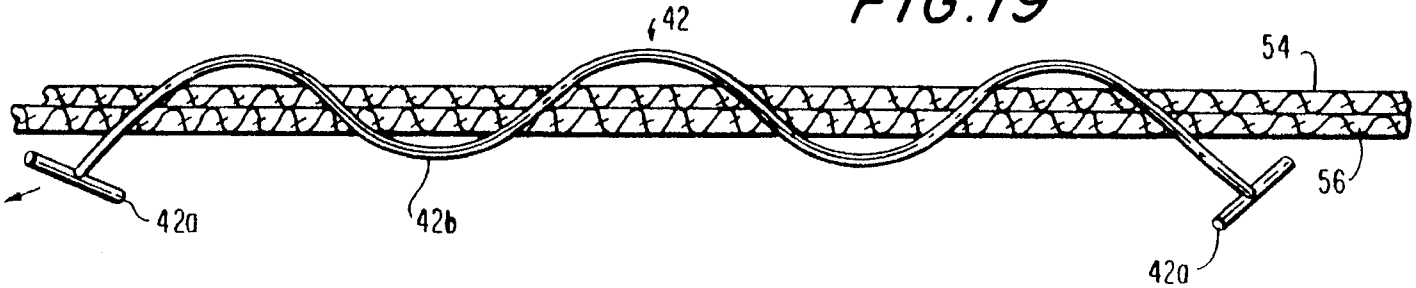

Similarly, as seen in FIG. 18, a sequin 52 can be attached to fabric using a tie 19 with having a bar 19 and a button 19*c*' at the ends of a stem 19*b* by first hand-threading ba 19*a* through the hole in sequin 52 and then using the implement in the manner earlier described to push bar 19*a* through sheet material such as fabric. Still similarly, as illustrated in FIG. 19, two or more layers of material, such as layers 54 and 56, can be fastened together with a tie 42 by loading a bar 42*a* into needle 18, and pushing needle 18 through materials 54 and 56 several times from alternating sides and then pulling out needle 18 to achieve the shown fastening.

I claim:

1. A hand operated implement for attaching articles such as buttons or tags to sheet material such as fabric with flexible ties, comprising:

a housing having a handle shaped and dimensioned to be grasped by the hand of a user and a barrel extending forwardly from the handle and having a channel formed therein;

a needle secured to and extending forwardly from the barrel and having a sharp free end for penetrating material and a groove extending rearwardly from said sharp end and shaped to accommodate a part of a flexible tie slidable along the groove for exiting the sharp end thereof;

a slide secured in said channel and configured to slide along the barrel, and a pusher mounted on the slide to slide in the groove of the needle between a tie loading position and a tie ejecting position, to push forward and out of the needle a flexible tie loaded into said groove in the needle, said slide and pusher being biased rearwardly; and a needle cover secured to the slide and movable between a storage position to cover the sharp end of the needle and an operative position exposing said sharp end;

said needle cover, when in the operative position, being slidable along the housing forwardly when pushed by a user to move the slide and the pusher forwardly and thereby push out of the sharp end of the needle a flexible tie loaded into said groove in the needle, and being slidable rearwardly under the bias applied to the slide to retract the pusher to said tie loading position so as to free the needle for the loading of another flexible tie therein.

2. An implement as in claim 1 including a stop operative when the needle cover is in its storage position to limit rearward travel of the slide under the bias acting thereon and thereby prevent rearward pressure on the sharp end of the needle by the needle cover.

3. An implement as in claim 2 including an interlocking mechanism engaging the needle cover with the housing when the needle cover is in its operative position to control the direction of movement of the needle cover.

4. An implement as in claim 3 in which said needle cover is pivotally secured to said slide to pivot between said storage position and said operative position relative to the slide.

5. An implement as in claim 4 in which said handle encloses a storage compartment and includes a closable access door to said storage compartment.

6. An implement as in claim 5 wherein said needle cover when in its operative position slides along a top side of said handle, and wherein said access door to the storage compartment is at a bottom side of the handle.

7. An implement as in claim 5 in which said access door to the storage compartment comprises a plate and said handle includes grooves in which the plate slides forwardly to close the storage compartment and rearwardly to open the storage compartment.

8. An implement as in claim 5 in which said housing comprises two half-shells which are substantially mirror images of each other relative to a plane which intersects centrally both the handle and the barrel.

9. An implement as in claim 1 in which said housing comprises two half-shells which are substantially mirror images of each other relative to a plane which intersects centrally both the handle and the barrel.

* * * * *